US006024599A

United States Patent [19]

Stathis et al.

[11] Patent Number: 6,024,599

[45] Date of Patent: Feb. 15, 2000

[54] POWER AND COMMUNICATIONS GROMMET

[75] Inventors: Peter Stathis, Bloomfield Hills; Richard N. Svenson, Northville, both of Mich.

[73] Assignee: Doug Mockett & Company, Inc., Hermosa Beach, Calif.

[21] Appl. No.: 09/003,731

[22] Filed: Jan. 7, 1998

[51] Int. Cl.[7] ..... H01R 13/60

[52] U.S. Cl. ..... 439/535; 174/48

[58] Field of Search ..... 439/535; 174/48, 174/49

[56] References Cited

U.S. PATENT DOCUMENTS

| | | | |
|---|---|---|---|
| 3,883,202 | 5/1975 | Konig . | |
| 4,372,629 | 2/1983 | Propst et al. . | |
| 4,551,577 | 11/1985 | Byrne . | |
| 4,747,788 | 5/1988 | Byrne . | |
| 4,828,513 | 5/1989 | Morrison et al. | 439/535 |
| 4,864,078 | 9/1989 | Bowman | 174/48 |
| 5,107,072 | 4/1992 | Morgan | 174/48 |
| 5,149,277 | 9/1992 | Le Master . | |
| 5,231,562 | 7/1993 | Pierce et al. . | |
| 5,351,173 | 9/1994 | Byrne . | |
| 5,380,951 | 1/1995 | Comerci et al. | 439/535 |

*Primary Examiner*—Paula Bradley
*Assistant Examiner*—Katrina Davis
*Attorney, Agent, or Firm*—Sanford Astor

[57] ABSTRACT

A grommet adapted to be placed through an aperture in a work surface, such as a desk. A lip, with a diameter larger than the aperture in the work surface, is located at the top of the housing, or body of the grommet, so that the lip rests over the aperture in the desk while the housing of the grommet passes through the aperture, so that the great majority of the grommet lies below the surface of the work surface. The grommet contains a plurality of electrical plugs or duplex receptacles and a plurality of modular couplers for communication terminals so that power or communications wires may be passed over the top of the grommet and down into the housing to be connected inside of the grommet. The grommet has a power wire and communication connection wires connected to the bottom of the grommet, for connection to a power source, such as a wall plug, and a communication source, such as a telephone plug. A cover or cap fits over the top of the housing to cover the incoming wires and the connections within, while leaving a space between the top of the housing and the cover so that the wires may pass through.

13 Claims, 4 Drawing Sheets

FIG. 1
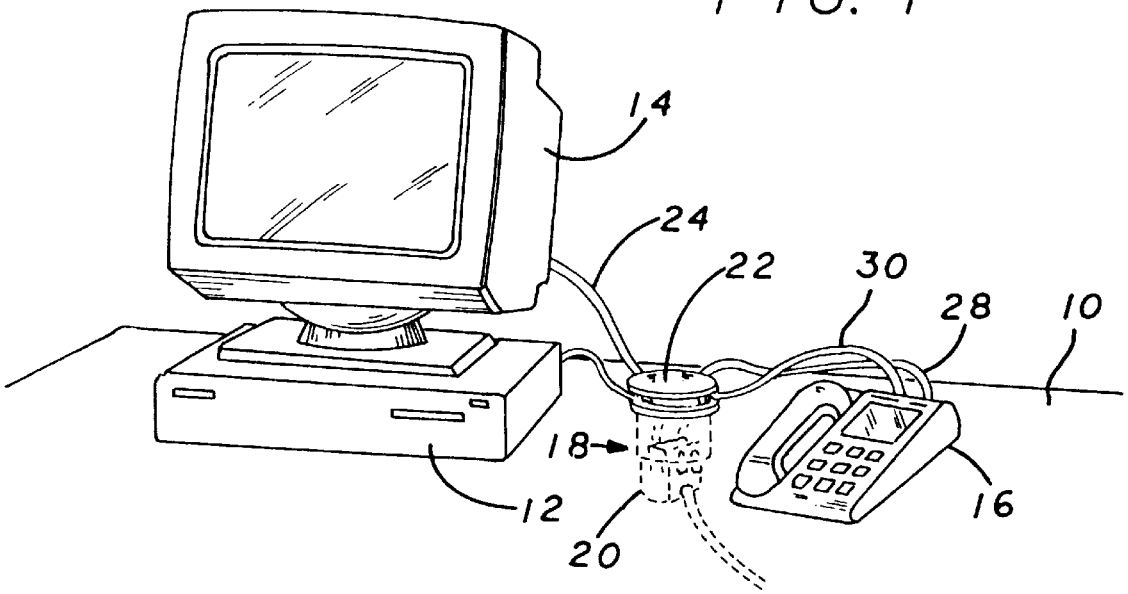
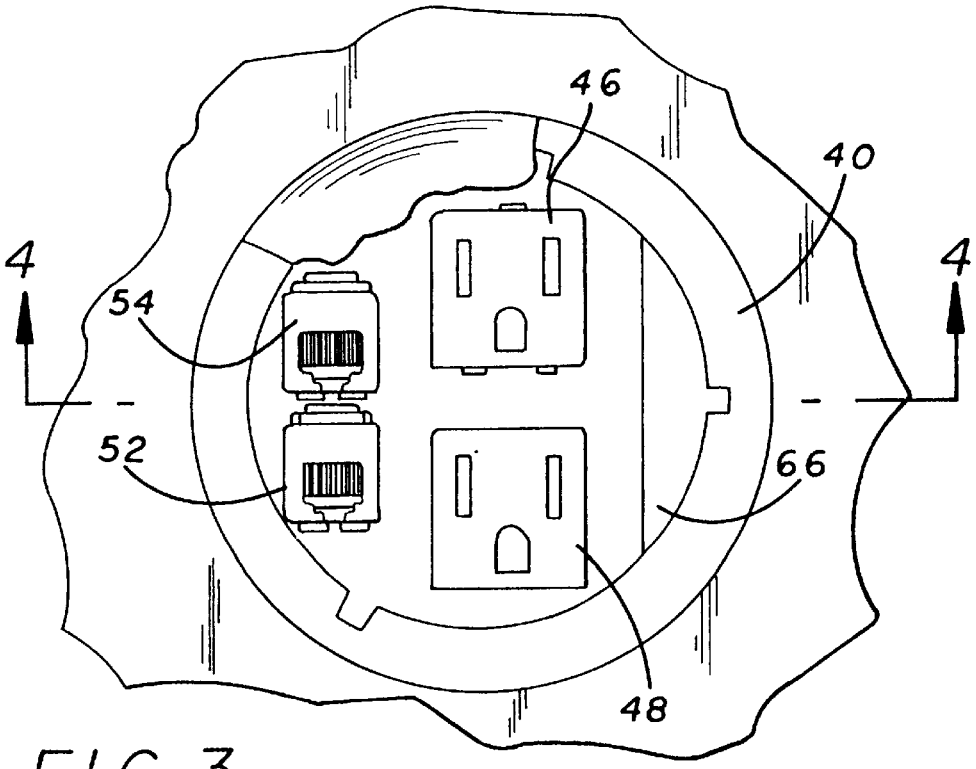
FIG. 3

POWER AND COMMUNICATIONS GROMMET

This invention was previously registered as Disclosure Document No. 419930, filed on May 27, 1997.

BACKGROUND OF THE INVENTION

The practical handling of power and data wiring in the workplace is a serious problem. Desktops and other work surfaces are all too often badly cluttered with a plurality of wires running across the desk in a haphazard manner. In addition, desktop devices often have to be plugged in when in use and unplugged when not in use or moved to other locations. Often this requires bending down under the work surface trying to find the wall outlet.

There has been a need for an efficient and yet aesthetic manner to handle these multiple wires that are needed in the work area. It has been known to have a retractably mounted receptacle for this purpose as shown in U.S. Pat. Nos. 4,747,788 and 5,351,173. These designs, however, suffer from the problem that the device must be pulled up from the work surface, the plugs inserted, and then the device pushed back down below the desk surface. This causes uneeded work on the part of the user and also suffers from possible breakage due to the repeated movement of the device from the open to closed positions using a fragile release mechanism. In addition, the wires plugged into the wall sockets are pulled up each time the device is raised, causing additional problems.

SUMMARY OF THE INVENTION

The power and communications device of this invention comprises a grommet adapted to be placed in an aperture in a desk or other work surface. An aperture is manufactured or drilled through the top of the work surface. A housing, adapted to fit into the aperture, contains a plurality of electrical receptacles and a plurality of data ports or communication receptacles. Cords adapted to plug into a power source, such as a wall socket or communications receptacle, are connected to the bottom of the housing. The communication receptacles comprise modular couplers so that communication wires, such as telephone, fax, modem wires, or any other plugs for specialty purposes, can be brought up and plugged into the bottom of the housing while the work surface operating devices, such as computers or telephones, are plugged in through the top of the housing.

Once inserted into the work surface the housing does not have to be moved, lifted or retracted in order to use it. The housing can, if desired, be fastened to the work surface by gluing or other convenient means. This is done by providing a lip, with a diameter larger than the aperture in the work surface, which is located at the top of the housing or body of the grommet so that the lip rests over the aperture in the work surface while the body of the grommet passes through the aperture. Thus, the great majority of the grommet lies below the surface of the desk or work surface, out of the way, and remains in that position. The electrical plugs or communication wires are simply plugged into the housing by reaching down into the grommet and plugging the plug or coupling into the receptacles in the housing.

An opening is provided which passes completely through the grommet in order to push excess wires or cords into or through the grommet, to remove them from the top surface of the work surface.

An attractive cap or cover is placed over the top of the housing, hiding the receptacles but leaving a small space for the wires to pass into the housing. The cover is easily removable and protects the interior of the housing as well as providing an attractive appearance to the work surface. If the unit is not in use, i.e. no wires are plugged in, the cap may be rotated so that it drops flush to the top of the housing, leaving no space between the cap and the housing, leaving a nearly flat work surface.

OBJECTS OF THE INVENTION

Accordingly, several objects and advantages of the invention are as follows:

It is an object of the present invention to provide a simple and convenient device which contains power and data receptacles at a work surface.

Another object of the invention is to provide a power and communications grommet which can easily be added to any existing work surface.

Yet another object of the invention is to provide a simple, convenient, attractive and yet inexpensive device which brings the connections for power and data cords, wires or cables to the work surface, thus eliminating the need to find the wall plug or data terminal.

BRIEF DESCRIPTION OF THE DRAWINGS

FIG. 1 is a perspective view of the device of the invention in place in a work surface;

FIG. 3 is a top plan view of the housing;

DETAILED DESCRIPTION OF THE INVENTION

Figure 2:
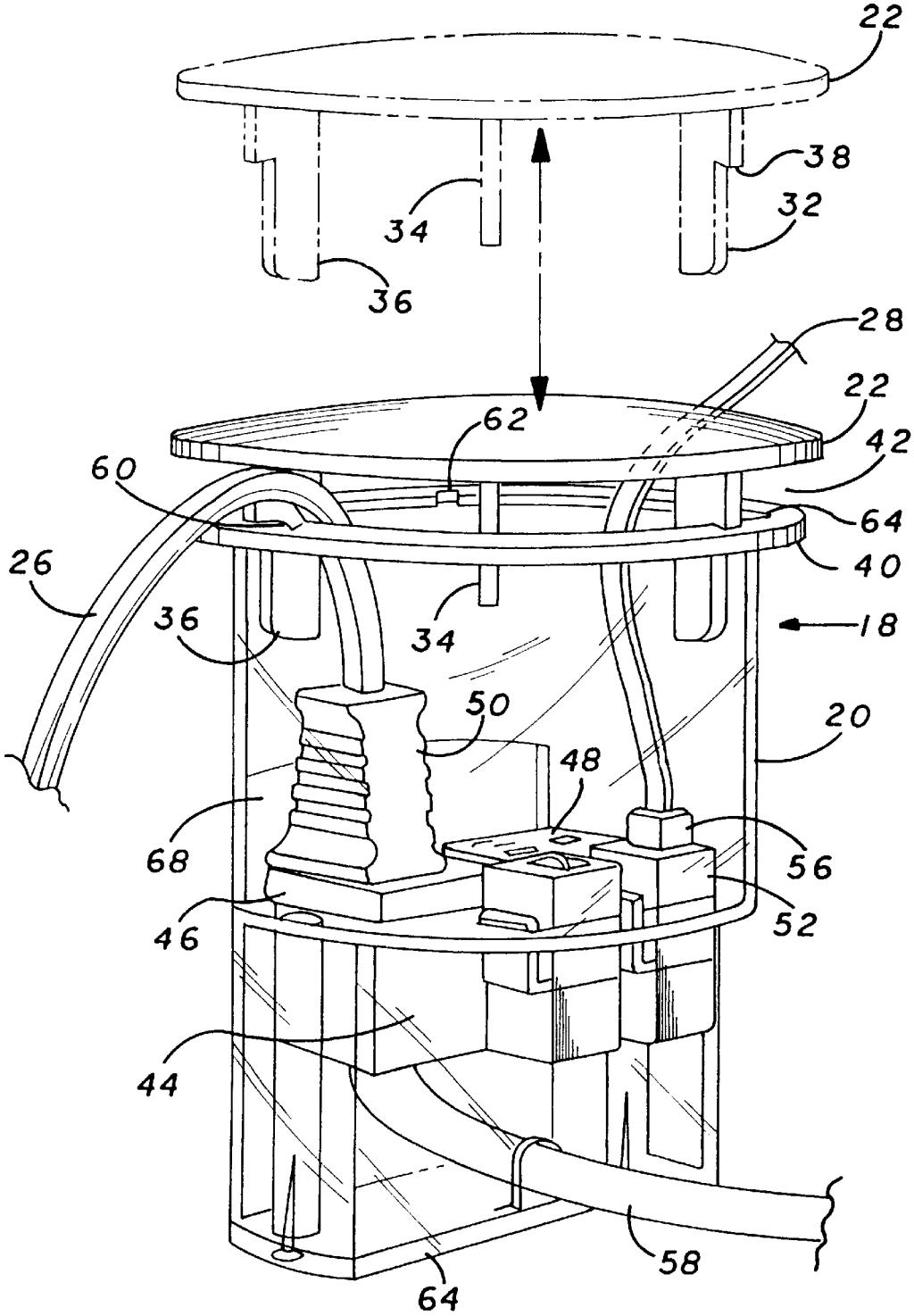
FIG. 2 is a perspective view of the device.

Referring now to FIG. 1, there is shown a work surface 10 on which there is stationed a computer CPU 12, a computer monitor 14 and a telephone 16. The power and communications grommet 18 of this invention is shown with the housing or body 20 of the grommet below the surface of work surface 10. Cap, or cover, 22 fits over the top of housing 20. Electrical power wires 24 from monitor 14 and 26 from CPU 12, pass through the space between cap 22 and body 20 of grommet 18. Communication wires 28 and 30 from telephone 16 do the same.

Figure 4:
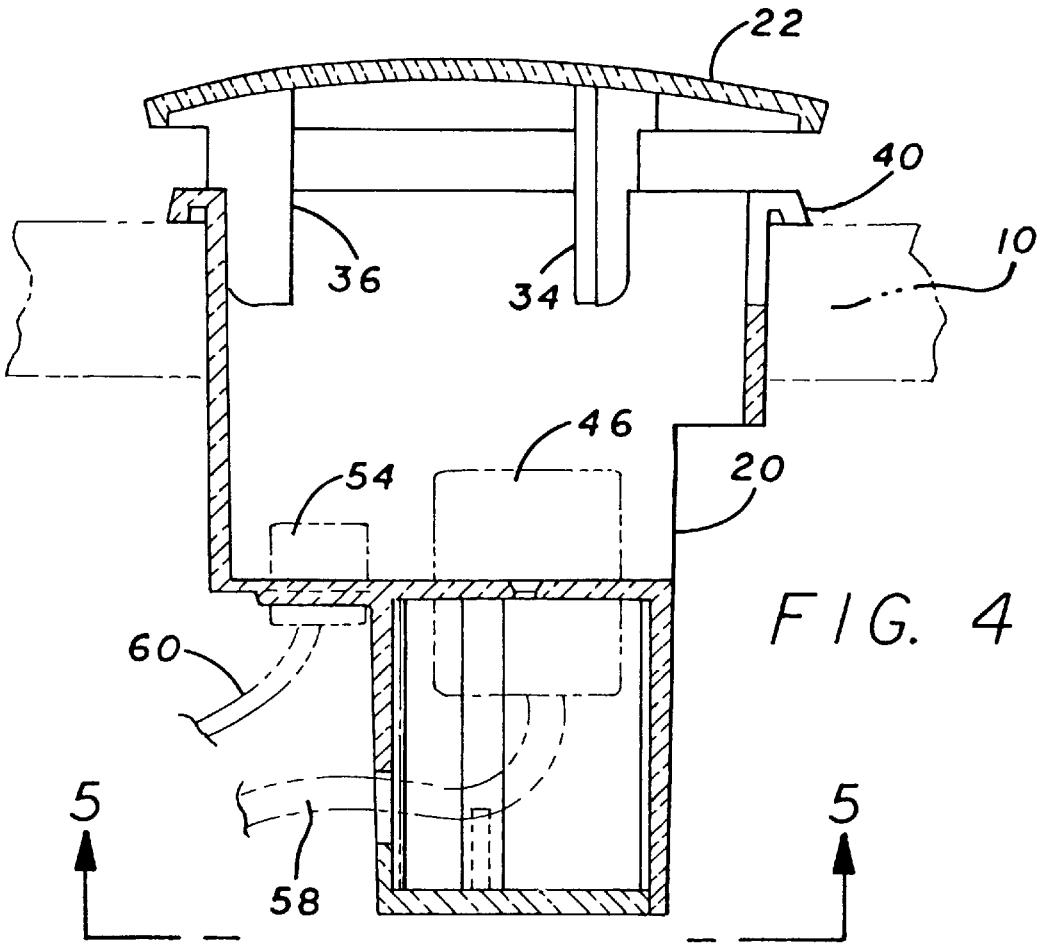
FIG. 4 is a cross-section taken on lines 4—4 of FIG. 3.
Figure 5:
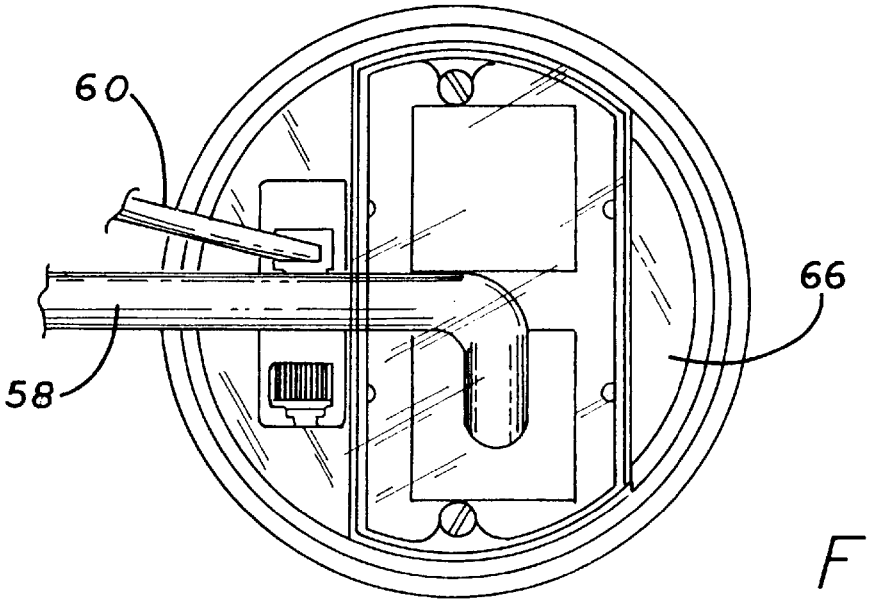
FIG. 5 is a bottom view of FIG. 4.

Referring to FIGS. 3, 4 and 5, there is shown body or housing 20 and removable cap 22. Cap 22 has a plurality of legs 32, 34 and 36 which are stepped, such as at 38, so that cap 22 rests on lip or rim 40 of housing 20 leaving an open space 42 between cap 22 and housing 20. Space 42 is provided so that wires 26 and 28 can pass between cap 22 and the top of housing 20 and into grommet 18. Lip 40 is larger in diameter than housing 20.

In use, an aperture large enough to fit housing 20 of grommet 18 is provided or made in the top of work surface 10. Housing 20 can then fit through and will lie beneath the surface of work surface 10 while lip 40 stops housing 20 from falling through the aperture in work surface 10.

Lip 40 of housing 20 has slots 60, 62 and 64 cut into it. If the grommet is not in use and no wires are plugged in, cap 22 can be rotated slighty so that legs 32, 34 and 36 fall into slots 60, 62, and 64. Cap 22 will then rest flush on the top of rim 40 leaving a virtually flat work surface and no open space.

Housing 20 has a plug or receptacle unit 44 which, as shown, has two duplex electrical receptacles 46 and 48. Plug 50 of wire 26 is shown plugged into receptacle 46. Receptacle unit 44 also has two communication terminals 52 and 54. Telephone jack 56 of wire 28 is plugged into terminal 52. While the device is shown with two electrical and two communication terminals, this can be varied to be any assortment desired and there can be from one to any number of terminals, depending only upon the size and shape of the housing of the grommet.

In addition, there are a variety of other types of plugs, such as various data plugs, which may be slightly different depending upon the manufacturer, microphone plugs, local area network (LAN) plugs, and other types of specialty plugs. Any of these can be included in the layout of receptacle unit 44. Each receptacle can be made to be removably inserted, such as by snapping into unit 44, so that they may be replaced by other types of receptacles without having to replace the entire grommet, or the entire receptacle unit 44 can be made to be removable, so that it can be replaced by a different receptacle unit having a different number and variety of receptacle plugs.

Power cable 58 passes from the bottom of receptacle unit 44 to be plugged into a power source such as an electrical wall plug. Receptacles 52 and 54 have terminals 53 and 55 at the bottom of each, so that a pair of communication wires, such as 61, for a telephone, fax, modem or other communication line can be plugged therein.

Housing 20 has a bottom plate 64 to keep the unit free of dust, dirt and moisture. Cap 22 provides both an attractive cover and protection for the unit, to prevent anything being inadvertently dropped in, such as coffee. Cap 22 may be slightly convex as shown, if desired, to prevent items from being placed thereon and for aesthetic reasons.

There is also provided an open space 66 which passes completely through housing 20, from top to bottom. Housing 20 may have an opening 68 in the side of the housing 20 or bottom plate 64 may be removed to have the bottom open, or both may be done. Openings 66 and 68 serve two purposes. First, excess wires or cords may be pushed from the work surface into the grommet and out the opening in the side 68 or the bottom, so that all excess wires are off of the work surface. Second, if desired, a wire or cord may be passed completely through the grommet and be plugged directly into the wall or communication receptacle. This gives the grommet of this invention tremendous versatility in the manner in which it can be utilized.

Figure 6:
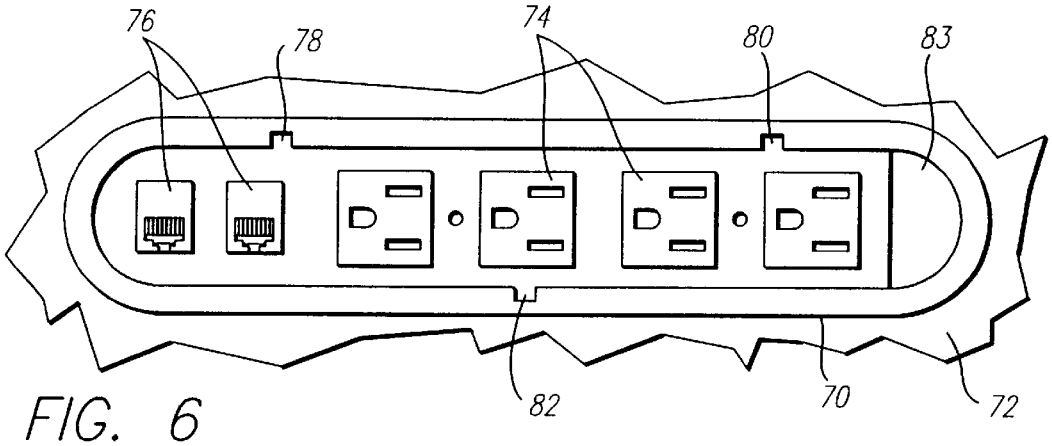
FIG. 6 is another embodiment of the invention.

FIG. 6 shows another embodiment of the invention which has the same components but simply a different elongated shape. The housing 70 has a lip 72 and a plurality of electrical receptacles 74 and data ports 76. Slots 78, 80 and 82 are provided in lip 72 to receive the matching legs of the cap, not shown, if no wires are being used and it is desired to have the grommet closed. The cap can be held open simply by reversing the cap so that the stepped legs rest on lip 72 as previously described. Space 83 passes all the way through housing 70 for excess wires, as previously described.

Figure 7:
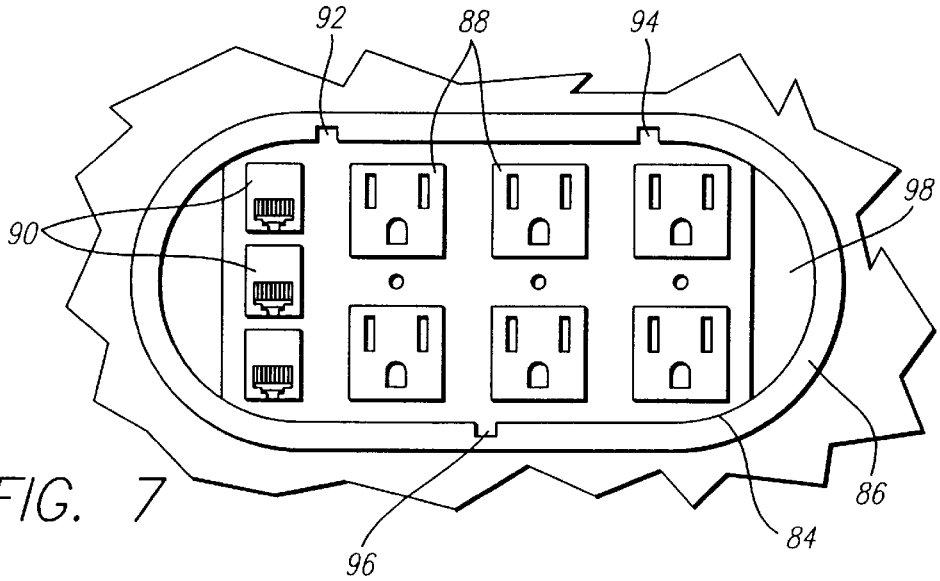
FIG. 7 is another embodiment of the invention.

FIG. 7 shows another embodiment having a racetrack shape, with housing 84, lip 86, a plurality of electrical receptacles 88 and data ports 90. Slots 92, 94 and 96 are provided to close the cap if desired. Space 98 is provided for excess wires or cords.

Figure 8:
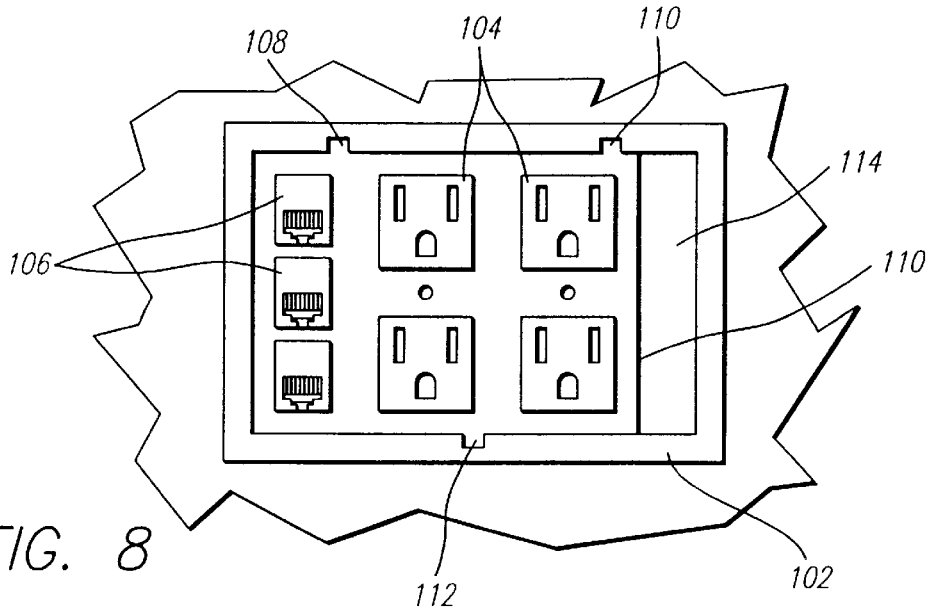
FIG. 8 is another embodiment of the invention.

FIG. 8 shows another embodiment having a rectangular shape with housing 100, lip 102, a plurality of electrical receptacles 104 and data ports 106. Slots 108, 110 and 112 are provided to close the cap if desired. Space 114 is provided for excess wires or cords.

As can be seen, the particular shape and size of the grommet depends upon the number and type of receptacles and ports desired as well as the shape desired by the particular designer. The grommet operates in the same manner regardless of shape or size. An aperture is manufactured into the work surface, or may be cut into any existing work surface, through which the housing is placed, held by the larger lip which rests on the work surface. Slots can be cut into the lip to fit the stepped legs of the cap, if it desired to close the top when no wires are passed through. The legs of the cap are only slightly larger in diameter than the housing so that the cap may easily be reversed to either sit above the housing on the step in its legs, to create the opening for the wires or, simply by reversing the cap, no matter which shape is utilized, the cap may rest flush against the housing to close the opening.

Having thus described the invention,

We claim:

1. A power and communications grommet for a work surface comprising, a housing adapted to fit through an aperture in the work surface, the housing containing a plurality of power and communication receptacles, the housing having a lip larger than the aperture, a cap adapted to fit over the top of the housing, a plurality of stepped legs attached to the cap to hold the cap raised above the top of the housing, to provide a space between the cap and the top of the housing for power and communication lines to be inserted into the grommet.

2. The grommet of claim 1 in which the receptacles each have a connection adapted to receive a plug from an operating device and the housing contains means to connect the receptacles to outside power and communications lines.

3. The grommet of claim 1 further comprising means to allow the cap to fit flush on the top of the housing when no wires are inserted into the grommet.

4. The grommet of claim 1 further comprising an opening in the side of the housing.

5. The grommet of claim 1 further comprising a bottom panel adapted to close the bottom of the housing.

6. The grommet of claim 1 in which the recptacles comprise a plurality of power receptacles and a plurality of commumications receptacles.

7. The grommet of claim 1 in which the lip has slots cut therein adapted to receive the stepped legs of the cap.

8. A power and communications grommet for a work surface comprising, a housing adapted to fit through an aperture in the work surface, the housing containing a receptacle unit, said receptacle unit having a plurality of power and communication receptacles on the top thereof, and an electrical power cord and a plurality of communication receptacles on the bottom thereof, the housing having a lip larger than the aperture, a cap adapted to fit over the top of the housing, a plurality of stepped legs attached to the cap to hold the cap raised above the top of the housing, to provide a space between the cap and the top of the housing for power and communication lines to pass into the grommet.

9. The grommet of claim 8 further comprising means to allow the cap to fit flush on the top of the housing when no wires pass into the grommet.

10. The grommet of claim 8 further comprising an opening in the side of the housing.

11. The grommet of claim 8 further comprising a bottom panel adapted to close the bottom of the housing.

12. The grommet of claim 9 in which the lip has slots cut therein adapted to receive the stepped legs of the cap.

13. The grommet of claim 8 further comprising an opening, passing completely from the top to the bottom of the housing, adjacent to the receptacle unit.

* * * * *